US005839971A

United States Patent [19]

Downing

[11] Patent Number: 5,839,971

[45] Date of Patent: Nov. 24, 1998

[54] GOLF SWING TRAINING DEVICE

[76] Inventor: Joseph M. Downing, 14718 Hartaway La., Cypress, Tex. 77429

[21] Appl. No.: 882,325

[22] Filed: Jun. 25, 1997

Related U.S. Application Data

[60] Provisional application No. 60/021,280 Jul. 5, 1996.

[51] Int. Cl.[6] ..... A63B 69/36

[52] U.S. Cl. ..... 473/263; 473/268

[58] Field of Search ..... 473/261, 263, 473/264, 257, 268; 273/186.1

[56] References Cited

U.S. PATENT DOCUMENTS

| | | | |
|---|---|---|---|
| 1,091,186 | 3/1914 | Brown | 473/268 X |
| 1,596,919 | 8/1926 | Burgoyne et al. | 473/264 |
| 2,754,125 | 7/1956 | Engler . | |
| 2,934,348 | 12/1960 | Magida . | |
| 3,375,010 | 3/1968 | Panza . | |
| 3,460,837 | 8/1969 | Cassa, Jr. . | |
| 3,554,555 | 1/1971 | Macri | 473/264 |
| 5,375,833 | 12/1994 | Marier, Jr. . | |
| 5,375,844 | 12/1994 | Waud | 473/268 |

*Primary Examiner*—George J. Marlo
*Attorney, Agent, or Firm*—Keeling Law Firm

[57] ABSTRACT

A golf swing training device that includes a guide arm supported by a support body, preferably a stake. The stake maintains the relative position of the guide arm when the device is in use. In the preferred embodiment and at its connecting end, the guide arm includes a connecting cavity extending vertically therethrough. When in use, the stake is inserted through the connecting cavity thereby frictionally retaining and maintaining the guide arm thereon. Also when in use, the guide arm extends directly over the golf ball and defines a golf swing area through which a proper golf swing may pass. At its focus end, the guide arm is narrower than the golf ball to avoid distracting the golfer's attention from the golf ball. The guide arm extends from the golf ball in a direction substantially perpendicular to the golf swing. When not in use, the support body, or stake, may be stored in a storage cavity within the guide arm. The storage cavity extends lengthwise through the guide arm from the guide arm connecting end towards but not through the guide arm focus end. In the preferred embodiment, the storage cavity and the connecting cavity intersect.

7 Claims, 3 Drawing Sheets

GOLF SWING TRAINING DEVICE

This Non-provisional application claims the benefit of U.S. Provisional application Ser. No. 60/021,280 filed by Downing on Jul. 5, 1996.

BACKGROUND OF THE INVENTION

1. Field of Invention.

This invention relates to a training device. More specifically, it is directed to an improved golf swing training device that trains the user to not "top" the golf ball and to concentrate on the ball.

For novice golfers, one of the most common weaknesses is their failure to keep the club head low enough as it impacts the golf ball. Such an improper swing results in "topping" of the golf ball which causes poor ball trajectory. The causes of the improper swing are many and include lifting the head too soon, not concentrating on the golf ball, improper wrist action, and the like. Additionally, a golfer's failure to concentrate on the golf ball can cause other problems such as slicing and hooking the golf ball.

2. Related Art.

Golf swing training devices are known to the prior art. Illustrative of such devices are U.S. Pat. No. 3,375,010 that issued to Panza on May 14, 1964. Panza discloses golf training device that includes a rod that extends over the ball parallel to the golf swing path.

Another prior effort to design a training device is shown in U.S. Pat. No. 5,375,833 that issued to Marier, Jr. on Dec. 27, 1994. Like Panza, Marier utilizes a rod that extends over the golf ball in a direction parallel to the golf swing. Additionally, Marier can pivot and disassemble when struck by a golf club and, thereby, minimize the impact damage.

Though the above mentioned devices may be helpful in training a golfer to not top the golf ball, they can be improved to provide more effective training, greater portability, and faster implementation with a lower cost. For example, both of the prior references cited utilize rods that extend parallel to the golf swing path. These parallel rods distract the golfer's eyes and concentration from golf ball as they draw the golfers eyes to the full length of the rod. Stated another way, the golfer first tends to concentrate on the end of the rod to avoid missing the end with the golf club head; then, the golfer focuses on the golf ball; and finally, the golfer focuses on the opposite end of the rod to avoid contacting it. Therefore, with the prior references, rather than concentrating on the golf ball and the swing, the golfer must focus on the length of the rod.

Additionally, the prior references are bulky which reduces their portability and increases the time required to implement the devices.

Therefore, a device that restricts the swing to a certain area, that prevents topping, and that focuses the eyes and concentration of the user on the golf ball is needed. Additionally, because golf involves an outdoor game of striking a golf ball, following the ball to its landing point, and hitting it from there, the training device must be portable to permit its use while playing, and learning, the game. Also, the device must be fast and simple to implement.

SUMMARY OF THE INVENTION

Accordingly, the objectives of this invention are to provide, inter alia, a golf swing training device that:

trains a golfer to have a proper golf swing and not top the golf ball;

defines a certain area through which the club head must pass to properly strike the golf ball;

warns the golfer when the club head is swung too high;

focuses the golfer's eyes and concentration on the golf ball;

facilitates a proper swing and, thereby, reduces hooking and slicing of the golf ball;

provides simple assembly and disassembly as well as simple and fast implementation;

quickly reduces to a compact form for portability;

is small enough to permit its portable, efficient use on the golf course while play a round of golf; and is low in cost and simple to manufacture.

Other objects of the invention will become apparent from time to time throughout the specification and claims as hereinafter related.

To achieve such improvements, my invention is a golf swing training device that uses a swing restriction means for defining a golf swing area through which a proper golf swing may pass when striking a golf ball. A focus means focuses the golfer's eyes and concentration on the golf ball and the golf swing area. Supporting the swing restriction means and the focus means in their proper positions relative to the golf ball is the support means. Additionally, the preferred embodiment includes a portative means for facilitating the compact portability and rapid implementation of the golf swing training device.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
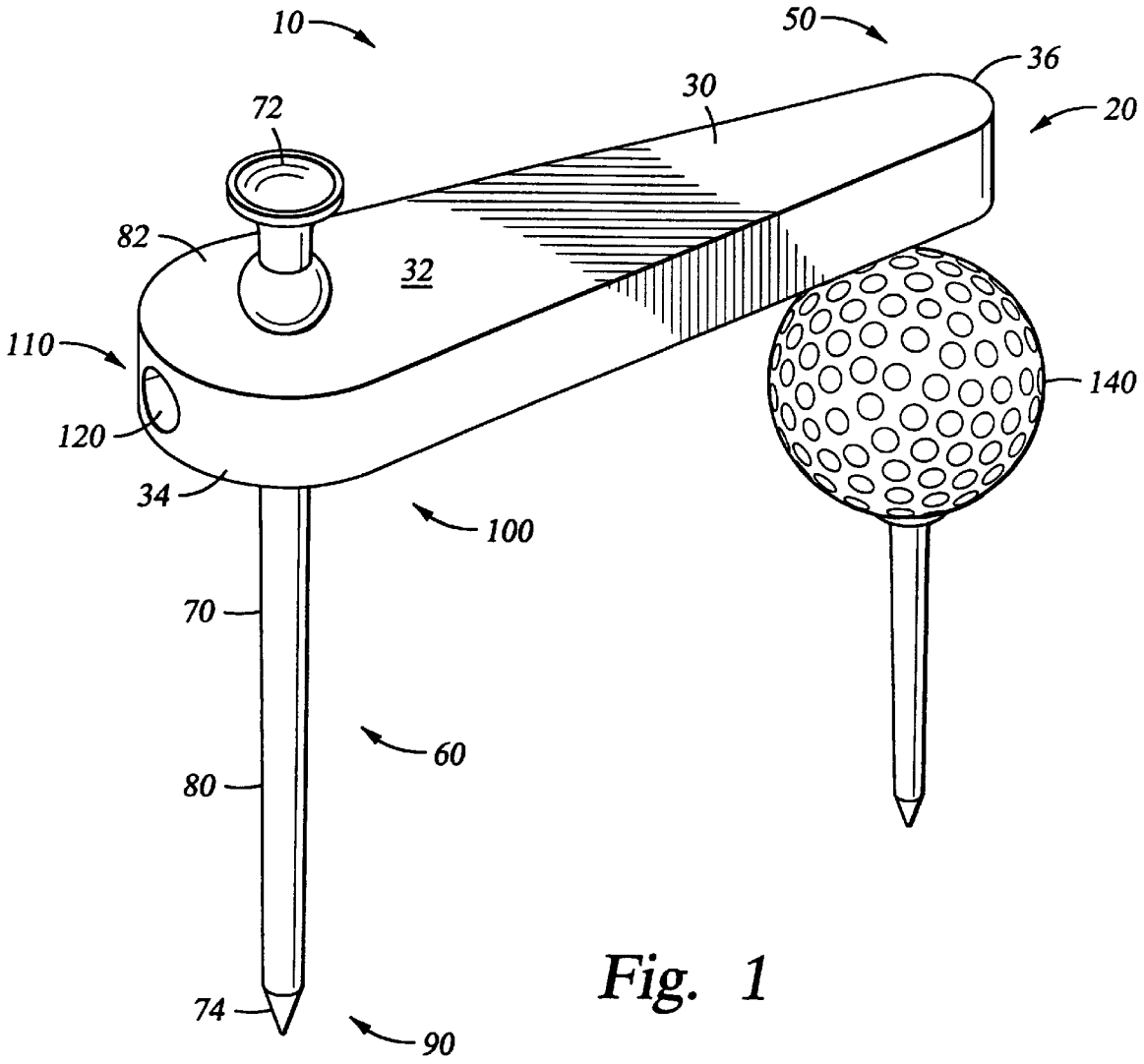
FIG. 1 is an isometric view of the golf swing training device.
Figure 6:
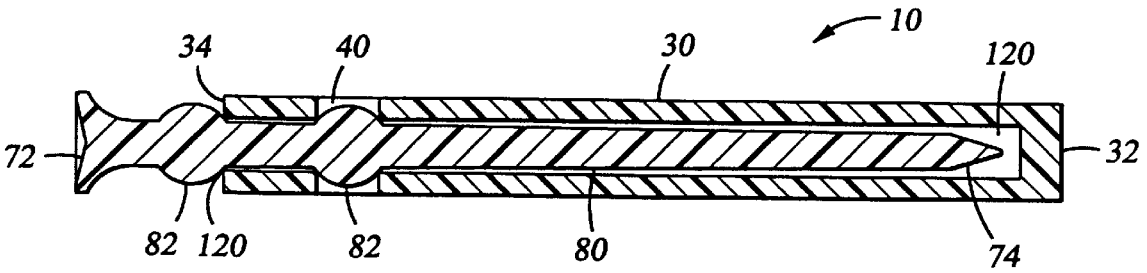
FIG. 6 is a lengthwise cross-sectional view of the golf swing training device with the stake positioned in the guide arm.
Figure 2:
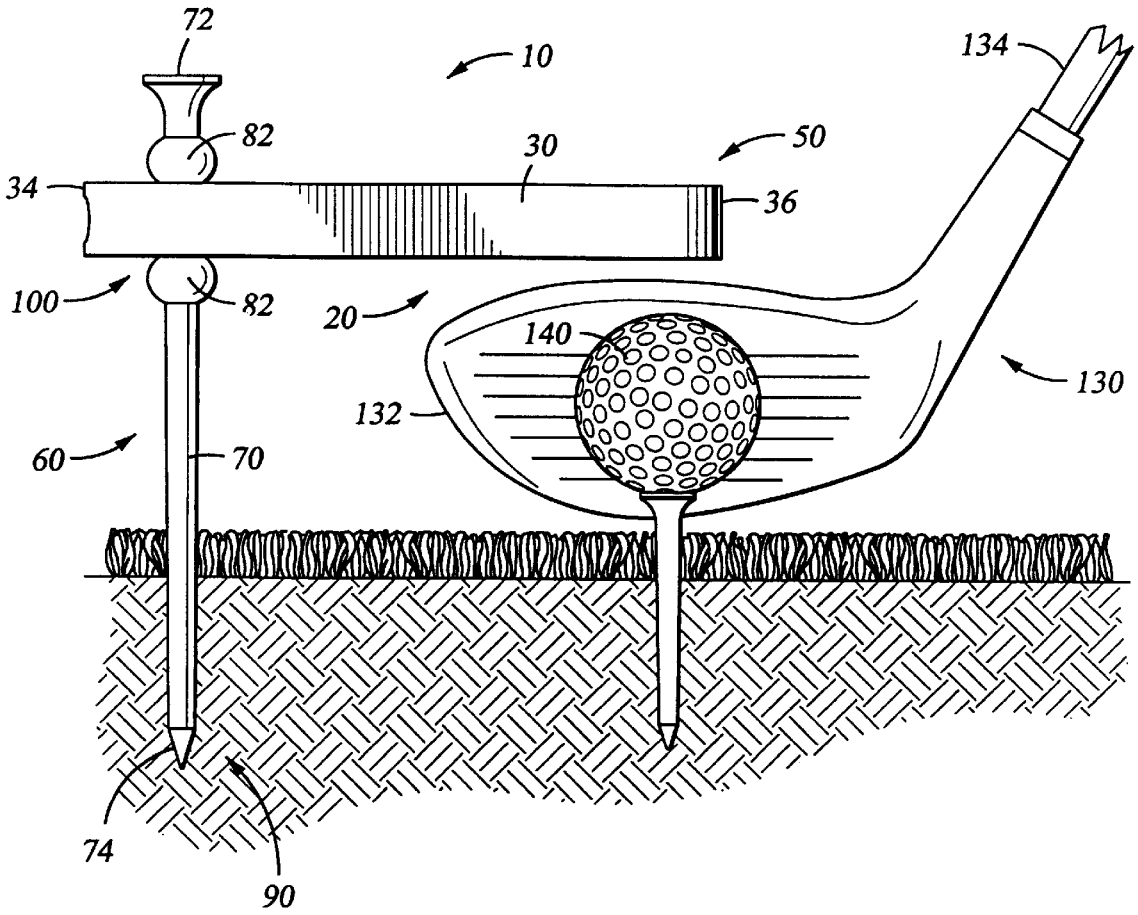
FIG. 2 is a side elevational view of the golf swing training device mounted in the ground showing its relative position to the golf ball and the golf club.
Figure 3:
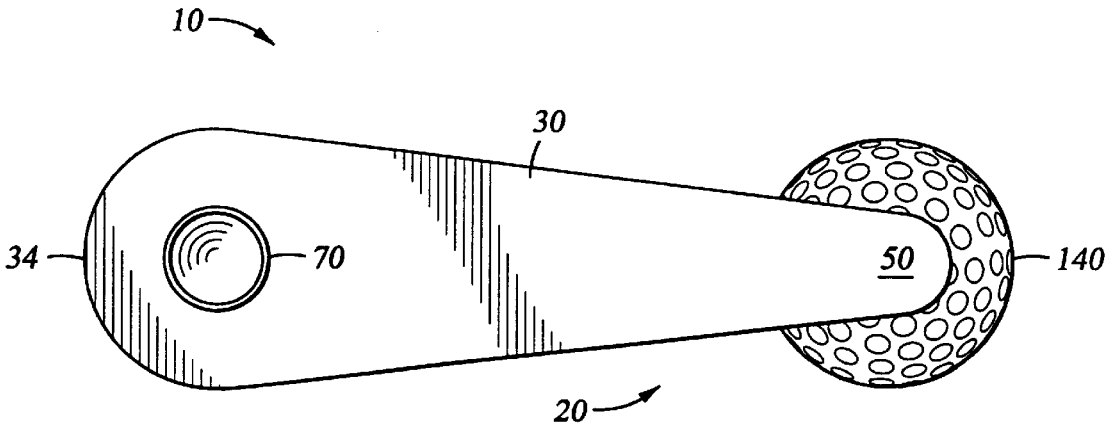
FIG. 3 is a top elevational view of the golf swing training device and its relative position to a golf ball.
Figure 5:
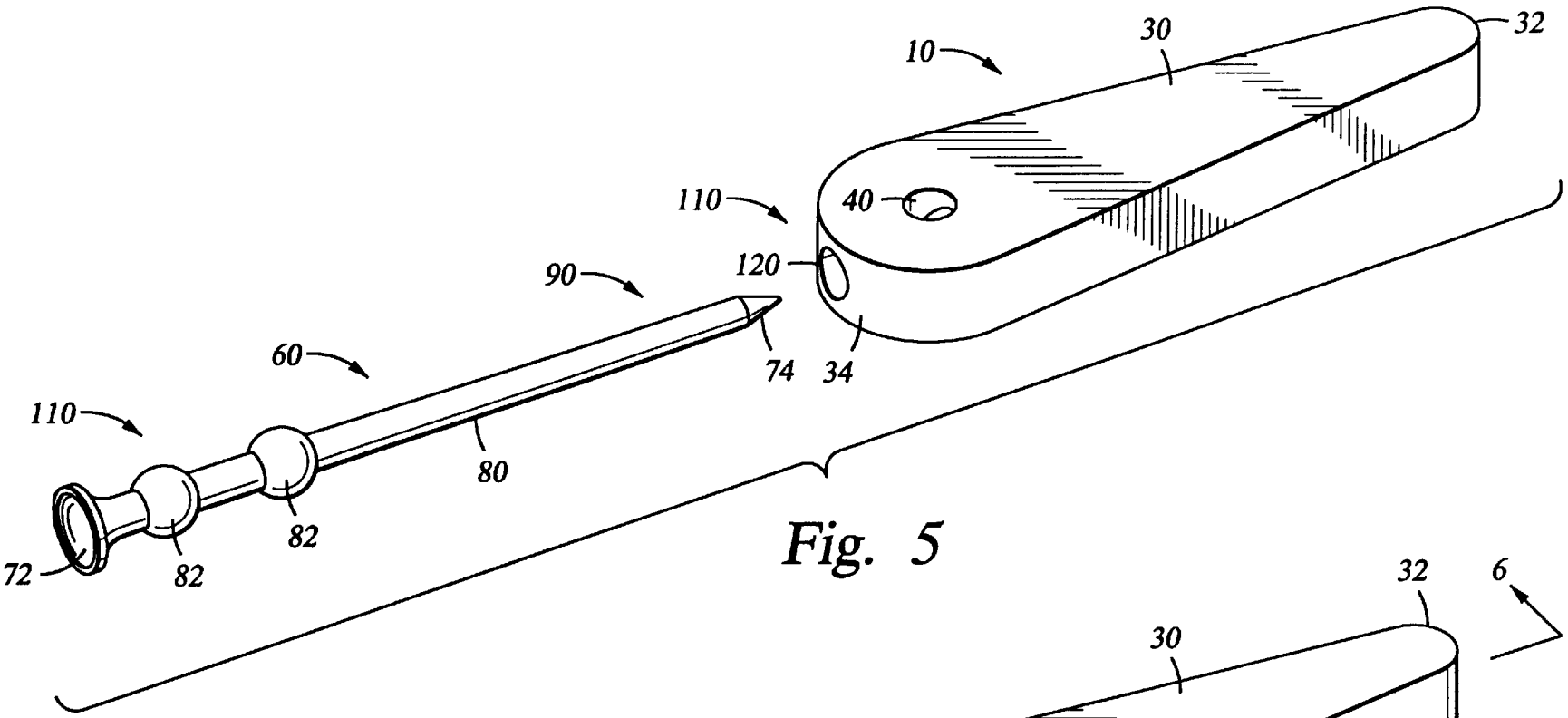
FIG. 5 is an isometric view of the stake removed from the guide arm.
Figure 4:
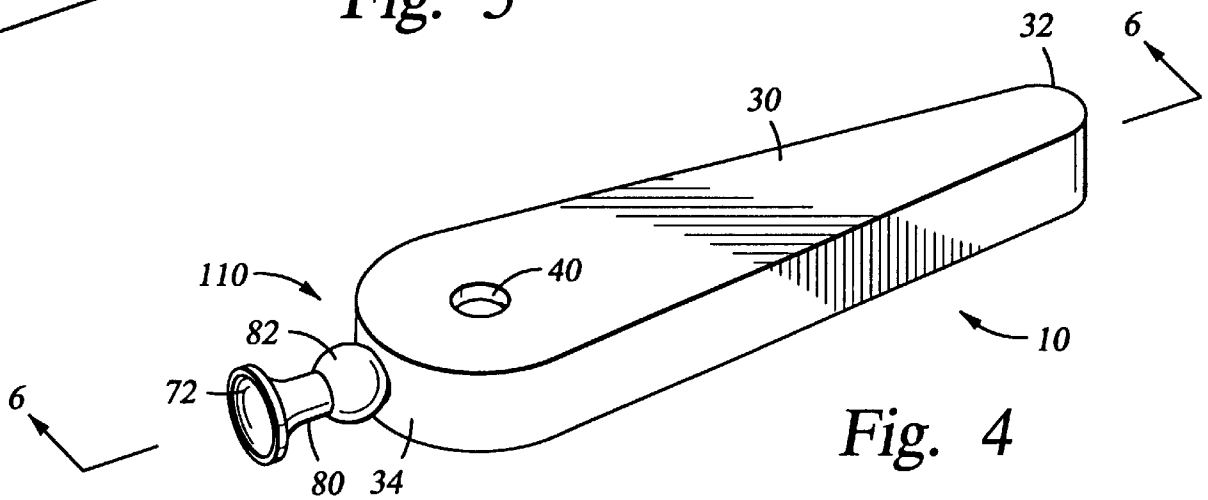
FIG. 4 is an isometric view of the golf swing training device with the stake positioned in the guide arm for portability.

The preferred embodiment of my invention is illustrated in FIGS. 1 through 5 and the golf swing training device is depicted as 10. The golf swing training device 10 includes swing restriction means 20, focus means 50, support means 60, and, preferably, portative means 110.

In a proper golf swing, the face of the golf club head 132 strikes the golf ball 140 in the center of the face. Often, novices to the game of golf have an improper swing that results in their lifting the golf club head 132 prior to striking the golf ball 140. Thus, the club head 132 strikes the top of the golf ball 140 (also known as "topping"). Also, a golfer's failure to concentrate on the golf ball 140 during the swing often results in hooking or slicing of the golf ball 140.

The swing restriction means 20 defines a golf swing area through which a proper golf swing may pass when striking a golf ball 140. As shown in the figures, the swing restriction means 20 defines an upper boundary above which the club head 132 should not pass in a proper golf swing. Thus, the golf swing area is simply the area between the golf restriction means 20 and the ground which act as boundaries. The golf ball 140 is positioned intermediate these boundaries. This golf swing area does not extend beyond the diameter of the golf ball 140 in a direction parallel to the golf swing, as prior references do. To the contrary, the golf swing area defined by the swing restriction means 20 is preferably less in width, as measured in a direction parallel to the golf swing, than the diameter of the golf ball 140.

Preferably, the swing restriction means comprises a guide arm 30 that extends over the golf ball 140 in spaced proximal relation thereto. When so positioned and supported, the guide arm 30 and the golf swing training device 10 are in an operational position. The guide arm 30 is positioned to provide sufficient clearance for a properly swung golf club 130 to pass therebelow without striking the guide arm 30. Additionally, when properly positioned, the guide arm 30 does not extend beyond the golf ball 140 so that the golf club shaft 134 does not strike the guide arm 30 during the swing. Should the golfer swing the golf club 130 too high, the golf club head 132 will strike the guide arm 30. When struck by the golf club 130, the guide arm 30 will move and will, thereby, warn the golfer that the swing was too high.

The guide arm 30 has an elongated guide arm body 32 with a connecting end 34 and a focus end 36. The support means 60 connects to the guide arm 30 at its connecting end 34. The focus end 36 is over the golf ball 140 when the guide arm 30 is in use. Therefore, the connecting end 34 has a greater width than the focus end 36. In this way, the connecting end 34 provides greater area for support and the focus end 36 provides for the desired smaller width proximal the golf ball 140.

The focus means 50 is for focusing a user's eyes and concentration on the golf ball 140 and the golf swing area. In general, the focus means 50 comprises the guide arm 30 extending over the golf ball 140 with the focus end proximal the golf ball 140 and the connecting end 34 distal the golf ball 140. The guide arm 30 preferably extends in a direction substantially perpendicular to the golf swing. Because the guide arm 30 extends only over the golf ball 140 and not beyond the ball's 140 diameter in a direction parallel to the golf swing, the guide arm 30 draws the user's eyes and concentration to the golf ball 140. Additionally, because an improper swing will result in the club head 132 striking the guide arm 30, the user must concentrate on completing a proper swing and, thus, on the golf ball 140 and the golf swing area. Further, the positioning of the guide arm 30, its perpendicular orientation to the golf swing, directs the user to the golf swing area and golf ball 140 as previously described. This orientation is contrary to prior designs that extend parallel to the golf swing and distract the golfer's eyes and attention from the golf ball 140. Finally, because the guide arm 30 narrows toward its focus end 36, the guide arm 30 creates a natural arrow pointing to the golf ball 140 and, thereby, conducts the golfer's concentration and eyes to the golf ball 140. Focusing the golfer's concentration on the golf ball 140 reduces topping as well as hooking of the golf ball 140.

The support means 60 maintains the required relative position of the swing restriction means 30 and the focus means 50 to the golf ball 140. Preferably, the support means 60 comprises a support body 70 having a top end 72 and a bottom end 74, attachment means 90, and connecting means 100. Attachment means 90 proximal the bottom end 74 of the support body 70 maintains the support body 70 in a substantially vertical position. The connecting means 100 removably and selectively connects the guide arm 30 to the support body 70, preferably at the top end 72.

In one embodiment, the support body 70 is an elongated stake 80 constructed so that it may be easily pressed into the ground. To achieve this desired construction, the stake 80 preferably has a substantially circular cross section and a diameter that decreases toward the bottom end 74 and terminates in substantially a point. However, the stake 80 may have any construction that facilitates its depression into the ground. To facilitate the depression into the ground, the stake 80 is constructed of a substantially rigid material. Because the stake 80 may be pressed into the ground, the stake 80 comprises the attachment means 90. The stake 80 has sufficient length that it may be partially embedded in the ground and provide the vertical offset required for the proper positioning of the guide arm 30. In the preferred embodiment, the guide arm 30 extends perpendicularly from the support body 70. Because the stake 80 is easily pressed into and removed from the ground, the stake 80 construction facilitates rapid and simple implementation of the golf swing training device 10.

As stated, the connecting means 100 removably and selectively connects the guide arm 30 to the support body 70. Preferably, the connecting means 100 includes a connecting cavity 40 that extends substantially vertically through the guide arm 30 proximal the connecting end 34 of the guide arm 30. The guide arm 30 is constructed of a resilient material. The stake 80 includes at least one enlarged portion 82 proximal the top end 72 of the stake 80. The cross sectional diameter of the connecting cavity 40 is substantially equal to or greater than the diameter of the stake 80 and is slightly less than the diameter of the enlarged portion 82. However, because the guide arm 30 is constructed of a resilient material, the enlarged portion 82 may pass through the connecting cavity 40. So that when the stake 80 is inserted with its bottom end 74 entering the connecting cavity 40 first, the enlarged portion 82 passes through the connecting cavity 40. Thus, when positioned with the guide arm 30 above the enlarged portion 82, the enlarged portion 82 maintains the guide arm 30 above the enlarged portion 82 in the operational position. Preferably, the stake 80 includes two enlarged portions 82 that are spaced relative to one another to facilitate positioning of the guide arm 30 therebetween. Therefore, the spacing of the enlarged portions 82 is substantially equal to the thickness of the guide arm 30. With two enlarged portions 30, the guide arm 30 is maintained between the enlarged portions 82 when in the operational position. Consequently, the guide arm 30 may be selectively positioned on and removed from the stake 80, thereby, facilitating fast and simple assembly, disassembly, and implementation.

The portative means 110 facilitates the compact portability and rapid implementation of the golf swing training device 10. Preferably the portative means 110 comprises a storage cavity 120 in the guide arm 30 in which the support body 70 may be stored. The storage cavity 120 extends lengthwise into the guide arm 30 from the connecting end 34 toward the focus end 36 partially therethrough. The storage cavity 120 opens to the exterior at the connecting end 34. Accordingly, the storage cavity 120, guide arm 30, and support body 70 construction permit selective placement of the support body 70 substantially within the storage cavity 120 for compact portability of the golf swing training device 10. The length of the storage cavity 120 is sufficient that substantially the full length of the support body 70 may be stored therein. However, to facilitate removal of the support body 70 from the storage cavity 120, a portion of the support body 70 remains outside the storage cavity 120 at all times.

Preferably, the connecting cavity 40 and the storage cavity 120 intersect. Like the connecting cavity 40, the diameter of the storage cavity 120 is equal to or greater than the diameter of the stake 80 and less than the diameter of the enlarged portion 82. Because the guide arm 30 is constructed of a resilient material, the stake 80 may be selectively inserted into the storage cavity 120 wherein the lower enlarged portion 82 is inserted into the storage cavity 120 and is received by the connecting cavity 40. Thus, the enlarged portion 120 acts as a detent that coacts with the connecting cavity to maintain the stake in the storage cavity 120 of the guide arm 30. When so positioned, the golf swing training device 10 is in its portable position.

With the stake 80 stored in the guide arm 30 the golf swing training device 10 is a compact, portable device. Due to the small size required for the stake 80 and the guide arm 30, the golf swing training device 10 is small enough for storage in a golfer's pocket. Because the guide arm 30 is resilient, it is more easily stored in a small, tight space. Further, because the stake 80 is stored in the guide arm 30 during transport, the likelihood of injury from the stake is low. The point of the stake 80 is sheathed in the guide arm 30.

The operation of the golf swing training device 10 is intuitive and easy. With the golf ball 140 positioned on the ground, the stake 80 is removed from its sheath, the storage cavity 120 of the guide arm 30, and positioned in the connecting cavity 40. The stake 80 is then pressed into the ground in spaced relation to the golf ball 140 so that the guide arm 30 extends over the golf ball 140 and extends away from the golfer in a direction substantially perpendicular to the anticipated golf swing.

The above examples are illustrative of a few of the many possible design variations that are equivalent to the preferred embodiment described herein and are included in the present invention.

I claim:

1. A golf swing training device comprising: swing restriction means for defining a golf swing area through which a proper golf swing may pass when striking a golf ball;

said swing restriction means comprises a guide arm having a connecting end and adapted to extend directly over the golf ball in spaced proximal relation thereto;

said guide arm positioned to provide sufficient clearance for a properly swung golf club to pass there below without striking said guide arm;

focus means for focusing a user's eyes and concentration on the golf ball and the golf swing area;

support means having a top end and a bottom end for maintaining the required relative position of said swing restriction means and said focus means to the golf ball;

connecting means for removably and selectively connecting said guide arm to said top end;

said guide arm including a connecting cavity extending vertically therethrough proximal said guide arm connecting end;

said guide arm constructed of a resilient material;

at least one enlarged portion on said support mean proximal said top end;

said at least one enlarged portion having a cross sectional diameter that is slightly greater than the diameter of said connecting cavity;

said connecting means comprising the insertion of said support mean through and the retention of said support mean within said guide arm connecting cavity;

so that said support mean may be selectively positioned through said connecting cavity which, due to the resiliency of said guide arm, may be passed through said connecting cavity beyond said at least one enlarged portion; and so that said at least one enlarged portion maintains the relative position of said guide arm to said support mean above said enlarged portion thereby defining an operational position when so connected.

2. A golf swing training device as claimed in claim 1 wherein:

said support mean including two enlarged portions; and said connecting means further comprising the insertion of said support mean through and the retention of said support mean within said guide arm connecting cavity so that said guide arm is maintained between said two enlarged portions when in said operational position.

3. A golf swing training device comprising:

swing restriction means for defining a golf swing area through which a proper golf swing may pass when striking a golf ball;

said swing restriction means comprises an elongated guide arm adapted to extend directly over the golf ball in spaced proximal relation thereto;

said guide arm, when maintained in an operational position, positioned to provide sufficient clearance for a properly swung golf club to pass therebelow without striking said guide arm;

a storage cavity in said guide arm extending partially lengthwise therethrough and opening to an exterior of said guide arm;

portative means for facilitating the compact portability and rapid implementation of said golf swing training device;

support means comprising a support body for maintaining the required relative position of said swing restriction means to said golf ball;

said support body constructed to releasably, selectively maintain said guide arm in said operational position; and said storage cavity and said guide arm constructed such that said support body may be selectively placed substantially within said storage cavity for compact portability of said golf swing training device.

4. A golf swing training device as claimed in claim 3 wherein:

said guide arm having a focus end and a connecting end.

5. A golf swing training device as claimed in claim 4 wherein:

said support body comprises a stake having a substantially circular cross section; and said storage cavity extends from said connecting end toward said focus end substantially and partially through said guide arm.

6. A golf swing training device as claimed in claim 5 further comprising:

a connecting cavity extending vertically through said guide arm proximal said connecting end;

said connecting cavity intersecting said storage cavity;

said guide arm constructed of a resilient material;

said stake having a top end and a bottom end;

at least one enlarged portion on said stake proximal said top end;

said at least one enlarged portion having a diameter that is slightly greater than the diameter of said storage cavity;

so that said stake may be selectively positioned into said storage cavity which, due to the resiliency of said guide arm, may be passed into said storage cavity beyond said at least one enlarged portion; and so that when said stake is positioned in said storage cavity, said connecting cavity receives said at least one enlarged portion and maintains the stake in said guide arm in a portable position.

7. A golf swing training device as claimed in claim 3 further comprising focus means for focusing a user's eyes and concentration on the golf ball.

* * * * *